US006512330B2

(12) United States Patent
Nakajima et al.

(10) Patent No.: US 6,512,330 B2
(45) Date of Patent: Jan. 28, 2003

(54) PLASMA DISPLAY PANEL

(75) Inventors: Yoshihiro Nakajima, Yamanashi (JP); Masaomi Ebe, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 139 days.

(21) Appl. No.: 09/769,302

(22) Filed: Jan. 26, 2001

(65) Prior Publication Data

US 2001/0011869 A1 Aug. 9, 2001

(30) Foreign Application Priority Data

Jan. 31, 2000 (JP) ..... 2000-022794

(51) Int. Cl.[7] ..... H01J 17/49
(52) U.S. Cl. ..... 313/586

(58) Field of Search ..... 313/582, 586, 313/587, 593

*Primary Examiner*—Vip Patel
(74) *Attorney, Agent, or Firm*—Arent Fox Kintner Plotkin and Kahn

(57) ABSTRACT

A plasma display panel includes a first additional dielectric layer 11A protruding from a backside of a dielectric layer 11 toward the inside of a discharge space S and extending along an edge of a discharge cell C extending in parallel to the row direction; and a second additional dielectric layer 11B formed to protrude from a portion of the backside of the dielectric layer 11 opposing a vertical wall 15*a* of a partition wall 15 toward the inside of the discharge space S, and to extend in the column direction to shield the adjacent discharge cells C in the row direction from each other in cooperation with the vertical wall 15*a*.

7 Claims, 7 Drawing Sheets

V 1 − V 1

V 2 − V 2

W1 – W1

W2 – W2

W3 – W3

V 3 — V 3

W 4 — W 4

W5 — W5

PLASMA DISPLAY PANEL

BACKGROUND OF THE INVENTION

1. Field of the Invention

The invention relates to a panel structure of a plasma display panel.

2. Description of the Related Art

Recent years, a plasma display panel of a surface discharge scheme AC type as an oversized and slim display for color screen has been received attention, which is becoming widely available.

FIG. 7 is a schematically plane view of a conventional plasma display panel of a surface discharge scheme AC type. FIG. 8 is a sectional view taken along the V3—V3 line of FIG. 7. FIG. 9 is a sectional view taken along the W4—W4 line of FIG. 7. FIG. 10 is a sectional view taken along the W5—W5 line of FIG. 7.

In FIG. 7 to FIG. 10, on the backside of a front glass substrate 1 to serve as a display screen of the plasma display panel, there is sequentially provided with a plurality of row electrode pairs (X', Y'); a dielectric layer 2 overlaying the row electrode pairs (X', Y'); and a protective layer 3 made of MgO which overlays a backside of the dielectric layer 2.

The row electrodes X' and Y' respectively consist of wider transparent electrodes Xa' and Ya' each of which is formed of a transparent conductive film made of ITO (Indium Tin Oxide) or the like, and narrower bus electrodes Xb' and Yb' each of which is formed of a metal film, complementary to conductivity of the transparent electrode.

The row electrodes X' and Y' are arranged opposing each other with a discharge gap g' in between, and alternate in the column direction to form display lines (row) L on a matrix display screen.

A back glass substrate 4 faces the front glass substrate 1 with a discharge space S', filled with a discharge gas, in between. The back glass substrate 4 is provided with a plurality of column electrodes DI arranged to extend in a direction perpendicular to the row electrode pairs X' and Y'; band-shaped partition walls 5 each extending between the adjacent column electrodes D' in parallel; and a phosphor layer 6 comprised of a red phosphor layer 6(R), green phosphor layer 6(G) and blue phosphor layer 6(B) which individually overlay side faces of the partition walls 5 and the column electrodes D'.

In each display line L, the column electrodes D' and the row electrode pair (X', Y') cross each other and the partition walls divide the discharge space S', to form a unit light emitting area, and thus a discharge cells C' is defined therein.

In the plasma display panel, as illustrated in FIGS. 8 and 9, on the :backside of the dielectric layer 2 and at a portion opposing to the back-to-back bus electrodes Xb' and Yb' extending in parallel to each other, an additional dielectric layer 2A is formed to extend along the bus electrodes Xb' and Yb' in parallel.

The additional dielectric layer 2A is formed to protrude from the backside of the dielectric layer 2 toward the inside of the discharge space S'. The additional dielectric layer 2A has a function of suppressing the spread of a surface discharge d, caused between the opposite transparent electrodes Xa' and Ya', toward the respective bus electrodes Xb' and Yb' in the discharge space S', in order to prevent occurrence of a false discharge between the discharge cells C' adjacent to each other in the column direction.

In the above surface discharge scheme AC type plasma display panel, an image is displayed as follows:

First, through address operation, discharge (opposite discharge) is caused selectively between the row electrode pairs (X', Y') and the column electrodes D' in the respective discharge cells C', to scatter lighted cells (the discharge cell in which wall charge is formed on the dielectric layer 2) and nonlighted cells (the discharge cell in which wall charge is not formed on the dielectric layer 2), over the panel in accordance with the image to be displayed.

After the address operation, in all the display lines L, the discharge sustain pulse is applied alternately to the row electrode pairs (X', Y') inunison. In each lighted cell, for every application of the discharge sustaining pulse, surface discharge is produced in each space between a pair of additional dielectric layers 2A adjoined to each other sandwiching the lighted cell. The surface discharge generates ultraviolet radiation, to excite the red phosphor layer 6(R) and/or the green phosphor layer 6(G) and/or the blue phosphor layer 6(B), formed in the discharge space S', for light emission, resulting in forming the display image.

As explained above, the conventional plasma display panel (PDP) is configured such that the additional dielectric layer, 2A which is formed at a position opposing to the bus electrodes Xb' and Yb' to extend in the row direction, limit's the spread of the discharge in the column direction to present interference between the discharges caused in the discharge cells C' adjacent to each other in the column direction.

However, as shown in FIG. 10, the conventional PDP has a clearance r' which is formed between the partition wall 5 and the dielectric layer 2 and between the adjacent discharge cells C' in the row direction in order to feed and exhaust a discharge gas into and from the discharge cells C'. For this reason, as illustrated in FIG. 7, the surface discharge d in one discharge cell may spread via the clearance r' to an adjacent discharge cell C' in the row direction, to possibly cause interfering discharges.

Although the spread of the discharge in the column direction is passably limited by the additional dielectric layer 2A as explained above, if the surface discharge d develops across the additional dielectric layer 2A, it is impossible to completely prevent the interference between the discharges in the adjacent discharge cells C' in the column direction.

The possibility of such interference between the discharges in the row direction and the column direction increases, as a pitch between the discharge cells decreases in relation to the high definition of an image. In the event of interfering discharges, lighted and unlighted discharge cells may be reversed producing an instable and inaccurate image.

SUMMARY OF THE INVENTION

The present invention has been made to solve the above problems associated with the conventional plasma display panel.

It is therefore an object of the present invention to provide a plasma display panel which is capable of effectively preventing interference between discharge in adjoining discharge cells to display a stable image.

To attain the above object, a plasma display panel according to a first invention includes, a plurality of row electrode pairs extending in a row direction and arranged in a column direction to respectively form display lines, and a dielectric layer overlaying the row electrode pairs on a backside of a front substrate; and a plurality of column electrodes extending in the column direction and arranged in the row direction on a back substrate facing the front substrate with a discharge space in between; and unit light emitting areas formed to be partitioned by a partition wall having at least vertical walls extending in the column direction in a discharge space corresponding to each intersection of the column electrode and the row electrode pair. Such plasma display panel features a first additional dielectric layer protruding from a backside of the dielectric layer toward the inside of the discharge space and extending along an edge of the unit; light emitting area extending parallel to the row direction; and a second additional dielectric layer formed to protrude from a portion of the backside of the dielectric layer opposing the vertical wall of the partition wall toward the inside of the discharge space, and extend in the column direction to shield the adjacent unit light emitting areas in the row direction from each other in cooperation with the vertical wall.

In the plasma display panel according to the first invention, a surface discharge caused in each row electrode pair upon forming an image, is located between the first additional dielectric layers to be limited from spreading into the adjacent unit light emitting area in the column direction. This prevents occurrence of interference between discharge in the adjacent unit light emitting areas in the column direction.

In addition, in the plasma display panel, the second additional dielectric layer formed on the dielectric layer shields the adjacent unit light emitting areas in the row direction in cooperation with the vertical wall of the partition wall. This inhibits the spreading of the surface discharge into an adjacent unit light emitting area located in the row direction, and thus prevent the occurrence of interference between discharge in the adjacent unit light emitting areas in the row direction.

As described above, according to the first invention, the first additional dielectric layer and the second additional dielectric layer effectively prevent the occurrence of interference between the discharges in any unit light emitting areas adjacent to each other in the row direction and the column direction. This therefore allows stable display of the images.

To attain the aforementioned object, a plasma display panel according to a second invention features, in addition to the configuration of the first invention, in that a clearance is formed in the second additional dielectric layer or the vertical wall of the partition wall to communicate between the unit light emitting areas adjacent to each other in the row direction.

According to the plasma display panel of the second invention, since the second additional dielectric layer and the vertical wall of the partition wall limit the spread of the surface discharge into an adjacent unit light emitting area located in the row direction, the occurrence of interference of the discharges is prevented. And also, since the adjacent unit light emitting areas in the row direction communicate with each other through the clearance formed in the second additional dielectric layer or the vertical wall of the partition wall, it is possible to feed and remove the discharge gas into and from the discharge space in each unit light emitting area while preventing the interference between the discharges. In addition, it is also possible to ensure the priming effect of causing the discharge between the adjacent discharge cells in the row direction such as in a chain reaction, namely causing the discharge to transfer to the adjacent discharge cell.

To attain the aforementioned object, a plasma display panel according to a third invention features, in addition to the configuration of the first invention, in that the partition wall has a transverse wall extending in the row direction, and defines the discharge space into a chessboard-square-like pattern with using the vertical walls and transverse walls to form the unit light emitting areas, and in that the first additional dielectric layer and the transverse wall of the partition wall shield the adjacent unit light emitting areas in the column direction from each other.

According to the plasma display panel of the third invention, since the adjacent unit light emitting areas in the column direction are shielded from each other by the first additional dielectric layer and the transverse wall of the partition wall, as compared with the case of shielding by only the first additional dielectric layer, it is possible to completely prevent the spread of the surface discharge into an adjacent unit light emitting area located in the column direction. This further effectively prevents the interference between the discharges, resulting in the stable displaying of images and high definition of images.

A plasma display panel according to a fourth invention features, in addition to the configuration of the first invention, in that a black layer is formed on a face of the vertical wall of the partition wall on a display surface side. This prevents reflection of ambient light incident upon the vertical wall of the partition wall.

A plasma display panel according to a fifth invention features, in addition to the configuration of the third invention, in that a black layer is formed on a face of the transverse wall of the partition wall on a display surface side. This prevents reflection of ambient light incident upon the transverse wall of the partition wall.

A plasma display panel according to a sixth invention features, in addition to the configuration of the first invention, in that a black layer is formed on the first additional dielectric layer. This prevents reflection of ambient light incident toward the transverse wall of the partition wall.

A plasma display panel according to a seventh invention features, in addition to the configuration of the first invention, in that a black layer is formed on the second additional dielectric layer. This prevents reflection of ambient light incident toward the vertical wall of the partition wall.

These and other objects and features of the present invention will become more apparent from the following detailed description with reference to the accompanying drawings.

DETAILED DESCRIPTION OF THE PREFERRED EMBODIMENT

Most preferred embodiment according to the present invention will be described hereinafter in detail with reference to the accompanying drawings.

Figure 1:
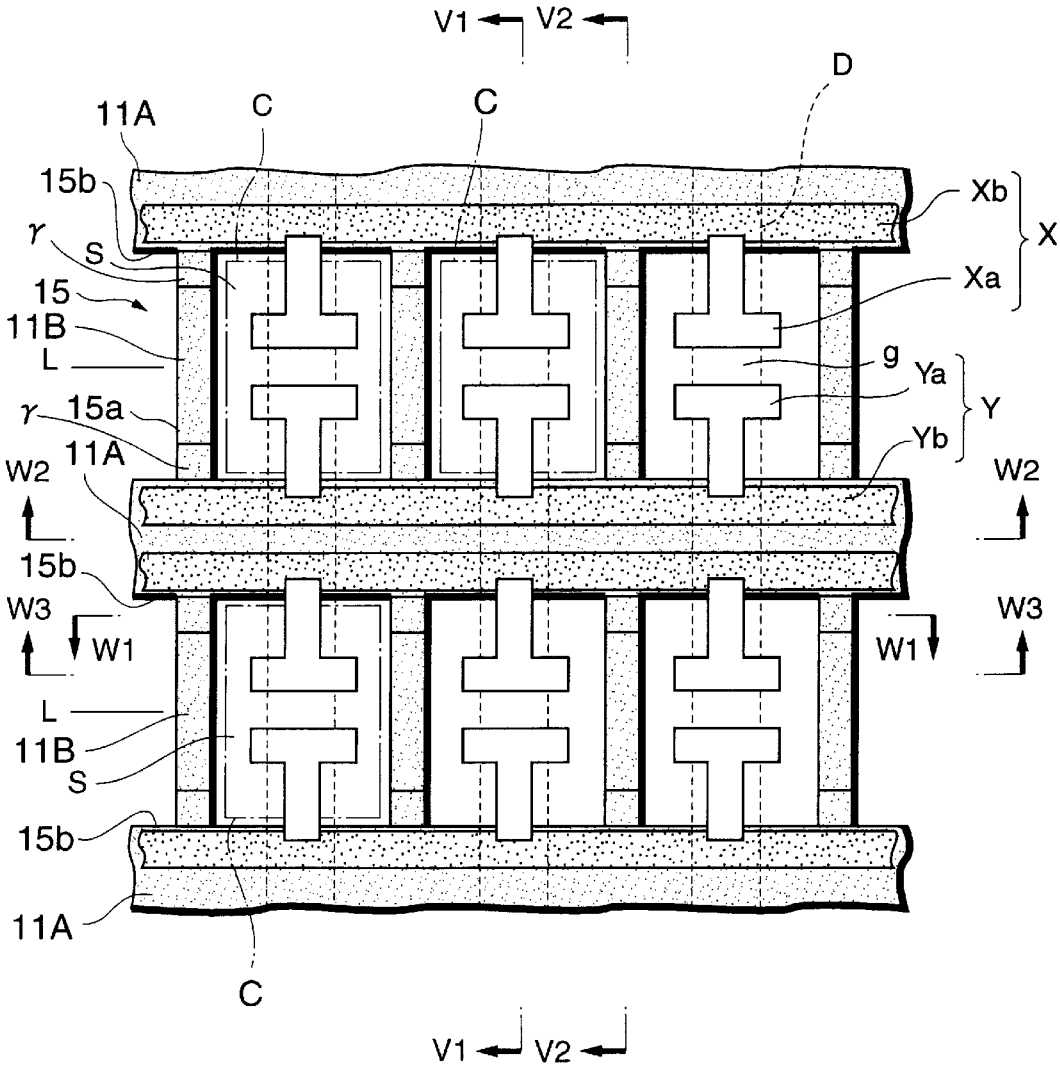
FIG. 1 is a schematically plane view illustrating an example according to a preferred embodiment of the present invention.
Figure 2:
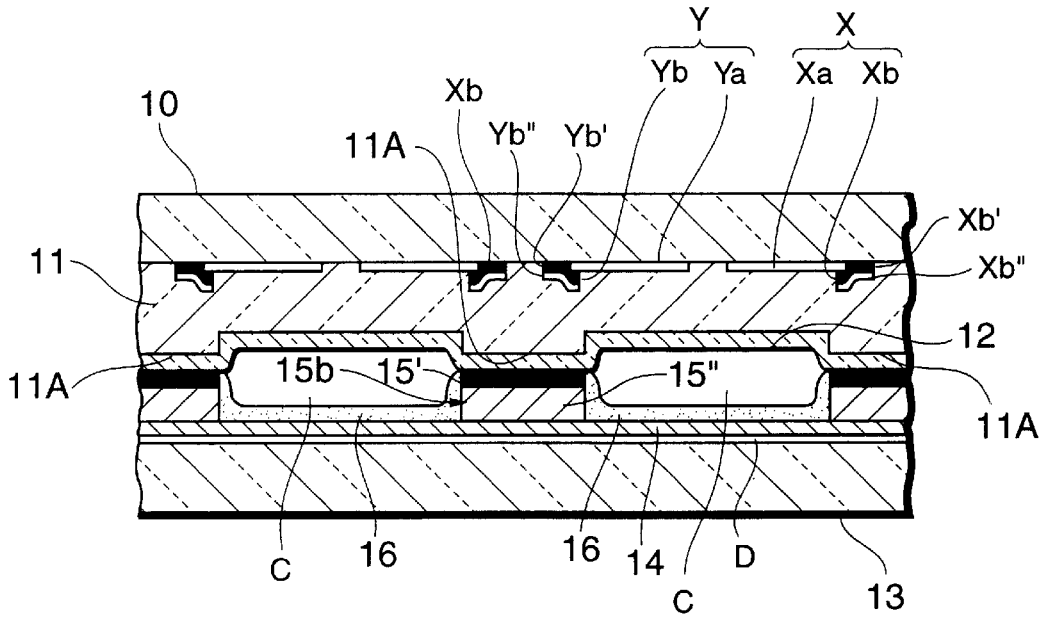
FIG. 2 is a sectional view taken along the V1—V1 line of FIG. 1.
Figure 3:
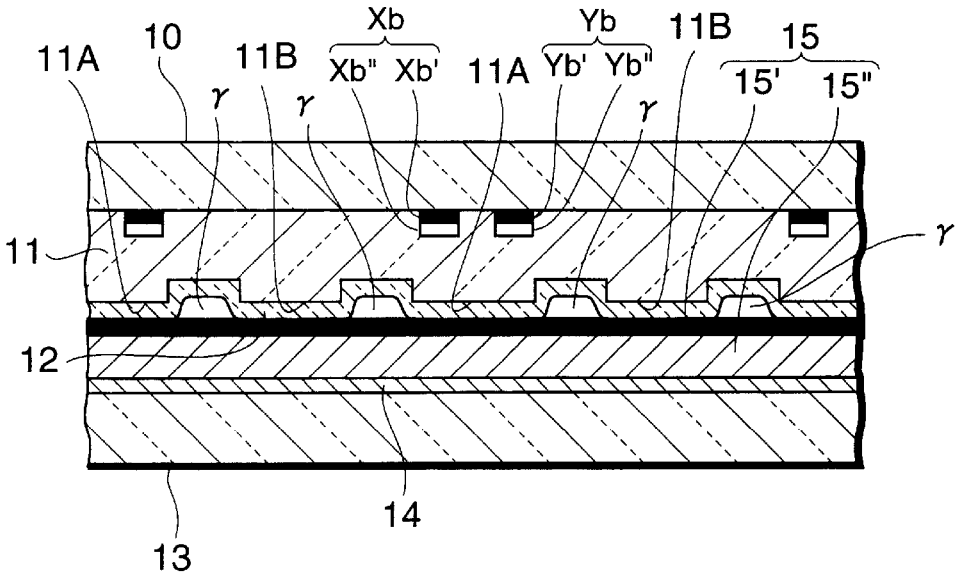
FIG. 3 is a sectional view taken along the V2—V2 line of FIG. 1.
Figure 4:
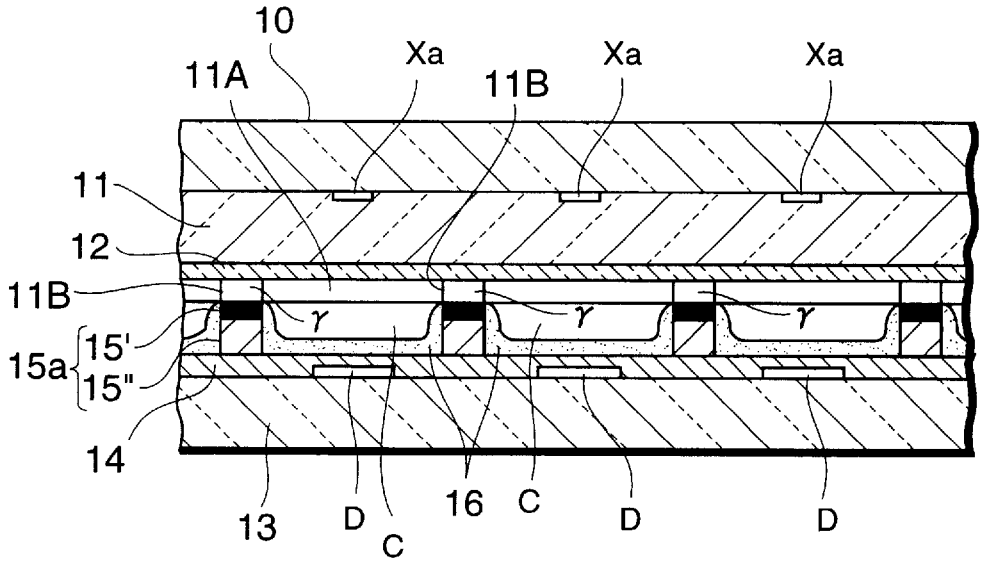
FIG. 4 is a sectional view taken along the W1—W1 line of FIG. 1.
Figure 5:
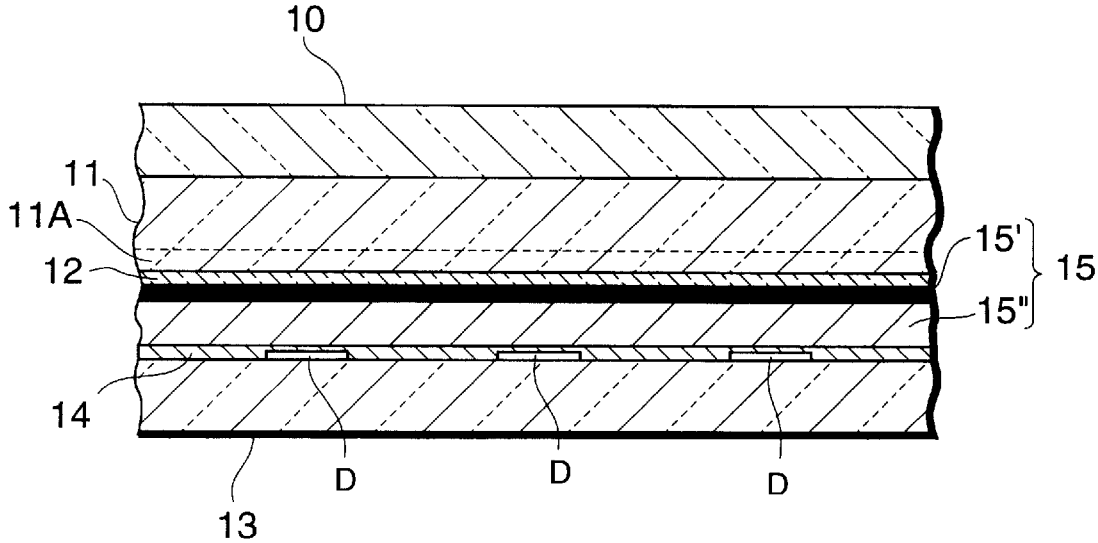
FIG. 5 is a sectional view taken along the W2—W2 line of FIG. 1.
Figure 6:
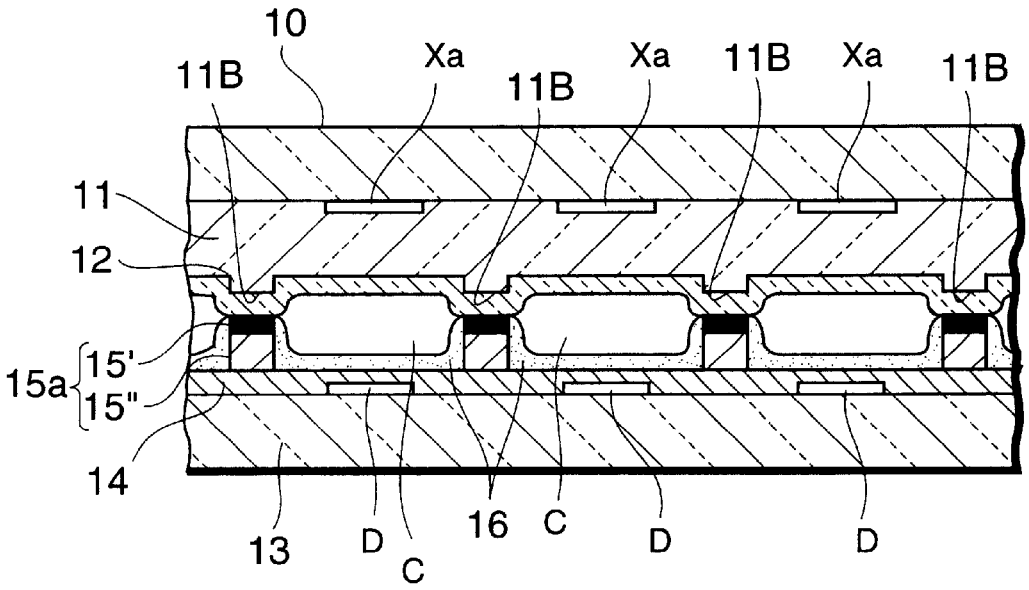
FIG. 6 is a sectional view taken along the W3—W3 line of FIG. 1.

FIGS. 1 to 6 illustrate an example of the embodiment of a plasma display panel (referred as "PDP" hereinafter) according to the present invention. FIG. 1 is a plane view schematically presenting the relationship between a row electrode pair and a partition wall of the PDP. FIG. 2 is a sectional view taken along the V1—V1 line of FIG. 1. FIG. 3 is a sectional view taken along the V2—V2 line of FIG. 1. FIG. 4 is a sectional view taken along the W1—W1 line of FIG. 1. FIG. 5 is a sectional view taken along the W2—W2 line of FIG. 1. FIG. 6 is a sectional view taken along the W3—W3 line of FIG. 1.

In FIG. 1 to FIG. 6, on a backside of a front glass substrate 10 serving as the display surface, a plurality of row electrode pairs (X, Y) are arranged in parallel to extend in the row direction (in the traverse direction in FIG. 1) of the front glass substrate 10.

The row electrode X is composed of transparent electrodes Xa formed in a T-like shape of a transparent conductive film made of ITO or the like, and a bus electrode Xb which is formed of a metal film extending in the row direction of the front glass substrate 10 to connect to a proximal end of the narrowed portion of the transparent electrode Xa.

Likewise, row electrode Y is composed of a transparent electrode Ya which is formed in a T-like shape of a transparent conductive film made of ITO or the like, and a bus electrode Yb which is formed of a metal film extending in the row direction of the front glass substrate 10 to connect to a proximal end of the narrowed portion of the transparent electrode Ya.

The row electrodes X and Y are alternated in the column direction (in the vertical direction in FIG. 1) of the front glass substrate 10. The transparent electrodes Xa and Ya arranged along the respective bus electrodes Xb and Yb, extend mutually toward a mate of the paired row electrodes such that the top sides (or the distal ends) of the wide portions of the transparent electrodes Xa and Ya mutually face :on the opposite sides of a discharge gap g having a predetermined width.

Each of the,bus electrodes Xb and Yb is formed in a double layer structure with a black conductive layer Xb' or Yb' on the display surface side and a main conductive layer Xb" or Yb" on the back surface side.

A dielectric layer 11 is further formed on the backside of the front glass substrate 10 to overlay the row electrode pairs (X, Y). Furthermore, on the backside of the dielectric layer 11, a first additional dielectric layer 11A is formed at each position which opposes the adjacent bus electrodes Xb and Yb of the respective row electrode pairs (X, Y) adjacent to each other, plus which opposes an area between the adjacent bus electrodes Xb and Yb. The first additional dielectric layer 11A is formed on the backside of the dielectric layer 11 to protrude therefrom and to extend in parallel to the bus electrodes Xb, Yb.

On the backside of the dielectric layer 11, as seen from FIG. 3, a second additional dielectric layer 11B is further formed at each position opposing a midpoint between the transparent electrodes Xa and Ya of the adjacent pairs arranged in the row direction. The second additional dielectric layer 11B is formed to extend at a predetermined length in the column direction and to protrude at the same height as that of the first additional dielectric layer 11A.

The second additional dielectric-layer 11B is designed to have a shorter length than a distance between the adjacent first additional dielectric layers 11A, to form a clearance r between each end of the second additional dielectric layer 11B and a wall face of each of the above first additional dielectric layers 11A.

On the backsides of the dielectric layer 11, the first additional dielectric layers 11A and the second additional dielectric layer 11B, a protective layer 12 made of MgO is formed to cover them.

Next, a back glass substrate 13 is placed in parallel to the front glass substrate 10. On the front surface of the back glass substrate 13 facing toward the display surface, column, electrodes D are disposed at regularly established intervals from one another to extend at positions, opposing the transparent electrodes Xa and Ya of the respective pairs of the row electrodes (X, Y), in a direction orthogonal to the row electrode pair (X, Y) (the column direction).

A white dielectric layer 14 is further formed on the face of the back glass substrate 13 on the display surface side to overlay the column electrodes D, and a partition wall 15 is formed on the dielectric layer 14.

The partition wall 15 is formed in a pattern, in which parallel lines cross at right angles, by a vertical wall 15*a* extending in the column direction between the adjacent column electrodes D arranged in parallel to each other, and a transverse wall 15*b* extending in the row direction at a position opposing each additional dielectric layer 11A.

The partition wall 15 defines the discharge space S between the front glass substrate 10 and the back glass substrate 13 into a chessboard-square-like pattern to form a quadrangular discharge cell C for each square opposing the paired transparent electrodes Xa and Ya of each row electrode pair (X, Y).

The partition wall 15 is formed in a double layer structure with a black layer (a light absorption layer) 15' on the display surface side and a white layer (a light reflection layer) 15" on the back surface side, which is configured such that the side wall facing the discharge cell C is almost white (i.e. a light reflection layer).

The face of the vertical wall 15*a* of the partition wall 15 on the display surface side is in contact via the protective layer 12 with the second additional dielectric layer 11B, while the face of the transverse wall 15*b* on the display surface side is in contact via the protective layer 12 with the first additional dielectric layer 11A. The first additional dielectric layer 11A and the transverse wall 15*b* shield the adjacent discharge cells C in the column direction from each other. The adjacent discharge cells C in the row direction is thus shield by the vertical walls 15*a* and the second additional dielectric layer 11B with the exception of a portion corresponding to the clearance r.

On five faces of a surface of the dielectric layer 14 and side faces of the vertical walls 15*a* and the transverse walls 15*b* of the partition wall 15 facing each discharge cell C, a phosphor layer 16 is formed to overlay all of them.

The phosphor layers 16 are set in order of red (R), green (G) and blue (B) for the sequence of discharge cells in the row direction.

The discharge space of each of the discharge cells C is filled with a discharge gas.

In the above PDP, a row electrode pair (X, Y) make up a display line (row) L on a matrix display screen. The partition wall 1s of the parallel-crosses-like pattern defines the discharge space S into the chessboard-square-like pattern to form the quadrangular discharge cells C.

Operation of displaying an image on the PDP is carried out as in the case of the conventional PDP.

Specifically, first, through address operation, the discharge is produced selectively between the row electrode pairs (X, Y) and the column electrodes D in the respective discharge cells C, to scatter lighted cells (the discharge cell formed with wall charge on the dielectric layer 11) and nonlighted cells (the discharge cell not formed with wall charge on the dielectric layer 11), in all the display lines Lover the panel in accordance with the image to be displayed.

After the address operation, in all the display lines L, the discharges sustain pulse is applied alternately to the row electrode pairs (X, Y) in unison. In each lighted cell, surface discharge is caused for every application of the discharge sustaining pulse.

In this manner, the surface discharge in each lighted cell generates ultraviolet radiation, and thus the red, green and blue phosphor layers 16 in the discharge space S are individually excited to emit light, resulting in forming the display screen.

In the aforementioned PDP, the first additional dielectric layer 11A formed on the dielectric layer 11 is in contact via the protective layer 12, overlaying the first additional dielectric layers 11A, with the surface of the transverse wall 15*b* of the partition wall 15 on the display surface side, to shield the adjacent discharge cells C in the column direction from each other. This prevents occurrence of interference between discharges of the adjacent discharge cells C in the column direction.

The second additional dielectric layer 11B formed on the dielectric layer 11 is in contact via the protective layer 12, overlaying the second additional dielectric layers 11B, with the surface of the vertical wall 15*a* of the partition wall 15 on the display surface side, to shield the adjacent discharge cells C in the row direction from each other. This prevents occurrence of interference between discharges of the adjacent discharge cells C in the row direction.

The feeding land removing of a discharge gas into and from each discharge cell C is performed through the clearance r, formed between the vertical wall 15*a* and the protective layer 12, at both ends of each second additional dielectric layer 11B. Moreover, the priming effect of causing the discharge between the adjacent discharge cells C in the row direction such as in a chain reaction, or causing the discharge to transfer to the adjacent discharge cell in the row direction, is secured through the clearance r.

It should be noted that the aforementioned PDP is configured such that the transparent electrodes Xa, Ya of the row electrode X, Y extend from the respective bus electrode Xb, Yb toward a mate of the paired row electrodes to independently shape into an island-like form in each discharge cell C. Therefore, even if each discharge cell C is reduced in size to increase definition of an image, it is possible to further prevent occurrence of interference between discharges of the adjacent discharge cells in the row direction.

Figure 7:
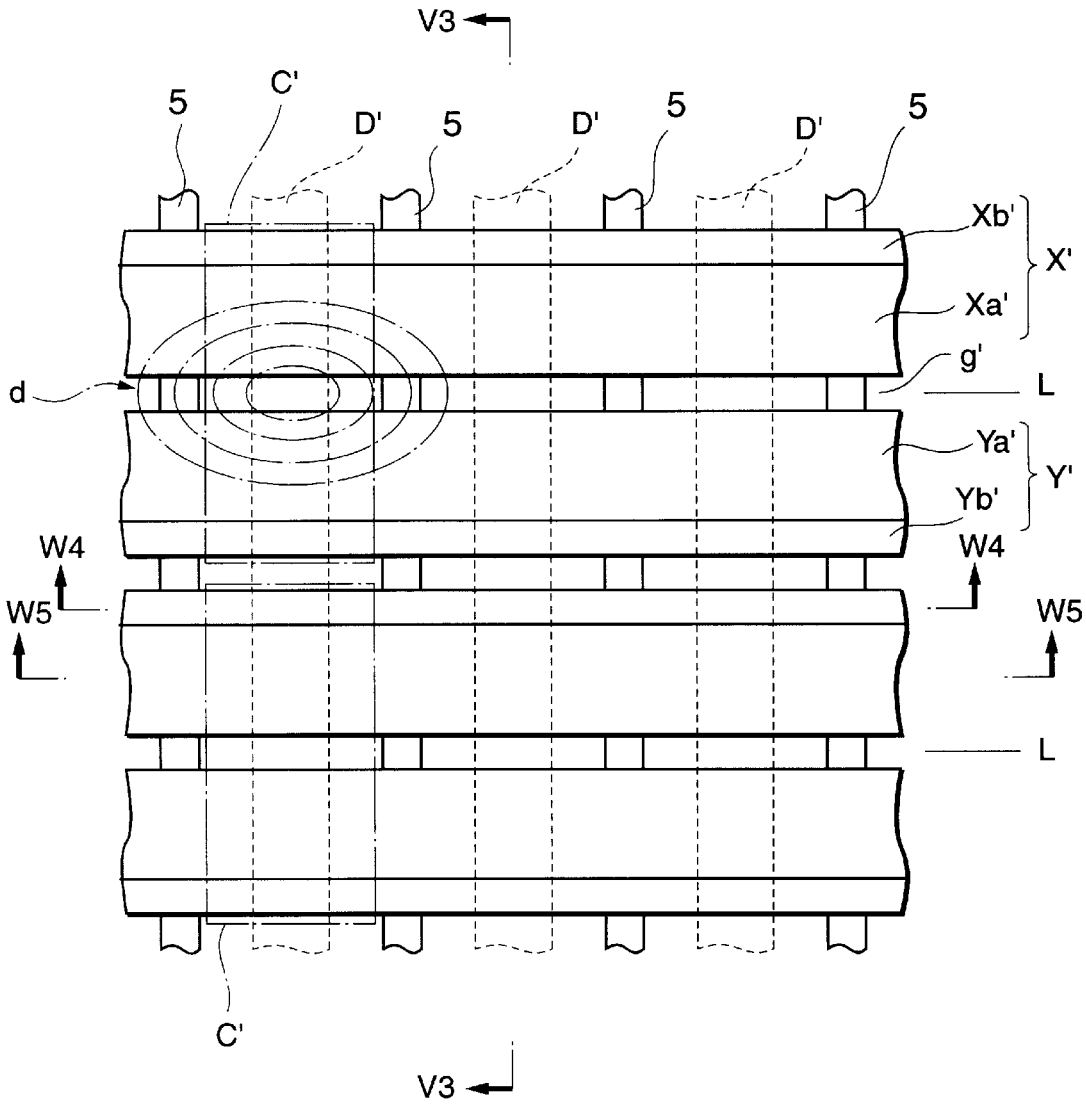
FIG.7 PRIOR ART
FIG. 7 is a schematically plane view illustrating a conventional plasma display panel.
Figure 8:
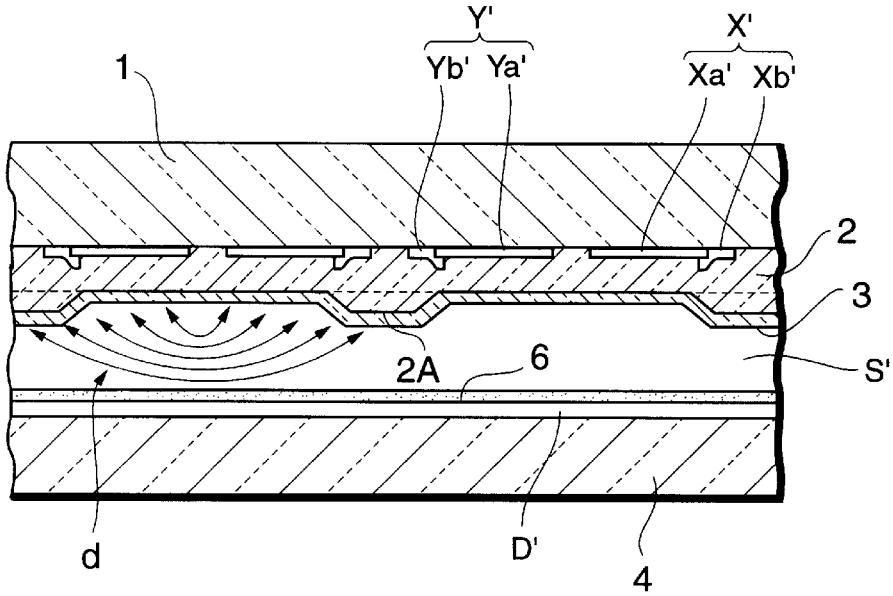
FIG.8 PRIOR ART
FIG. 8 is a sectional view taken along the V3—V3 line of FIG. 7.
Figure 9:
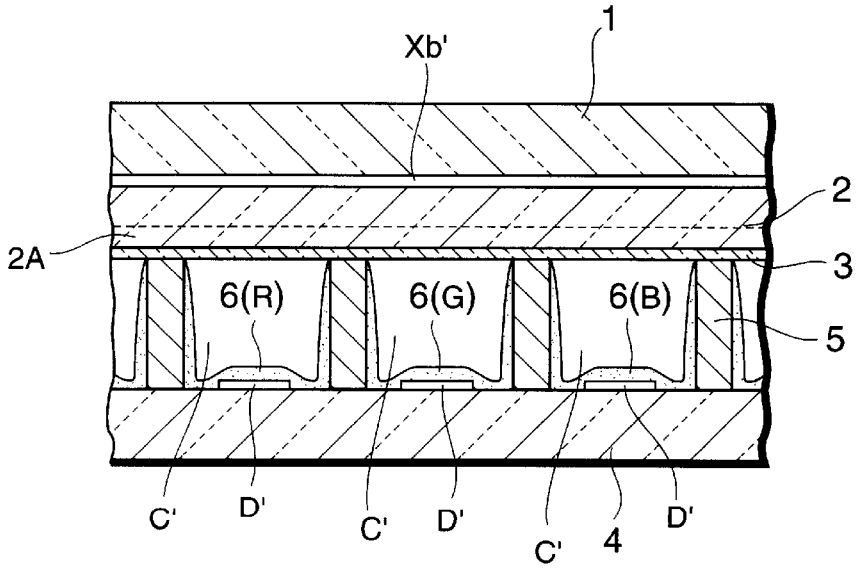
FIG.9 PRIOR ART
FIG. 9 is a sectional view taken along the W4—W4 line of FIG. 7.
Figure 10:
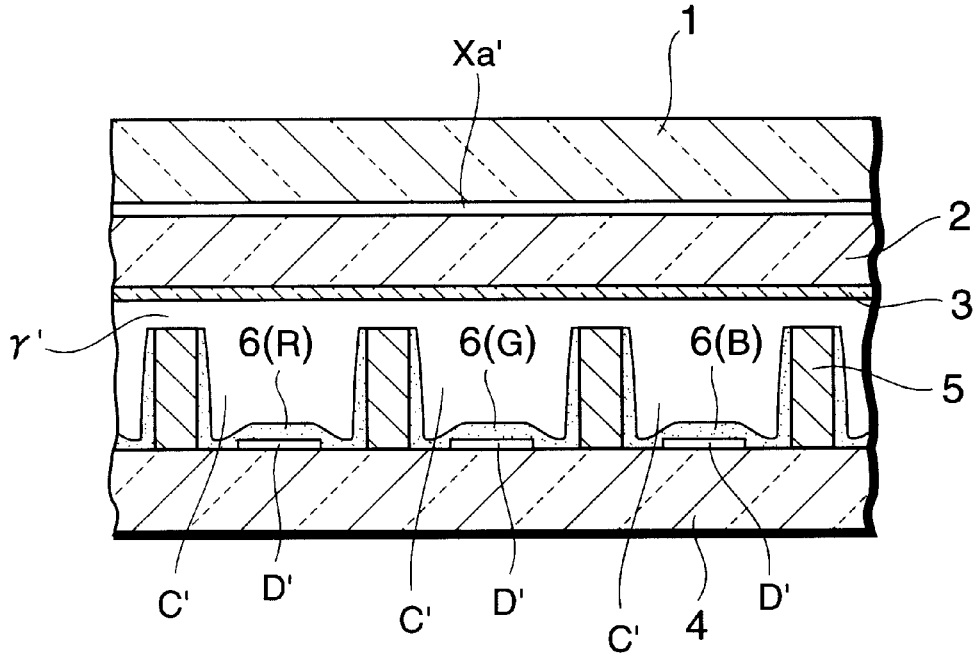
FIG.10 PRIOR ART
FIG. 10 is a sectional view taken along the W5—W5 line of FIG. 7.

In the aforementioned example, the explanation has been made for the PDP in which the partition wall for defining the discharge cells has the vertical walls and transverse walls and the discharge space is defined in the chessboard-square-like pattern. However, similarly, a PDP having a band-shaped partition wall extending in the column direction as illustrated in FIG. 7, can also prevent the occurrence of interference between the surface discharges upon forming an image, in between any adjacent discharge cells: in the column direction and in the row direction by means of forming a first additional dielectric layer extending in the row direction and a second additional dielectric layer extending in the column direction on the backside of the dielectric layer.

Further, in the aforementioned example, the clearance establishing communication between the adjacent discharge cells in the row direction is formed on the second additional dielectric layer side, but the clearance may be formed on the vertical wall.

Additionally, in the aforementioned example, the black layer is formed on the face of the partition wall on the display surface side to make up the black matrix, but it may be formed in the first and second additional dielectric layers to make up the black matrix.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction on a back substrate facing the front substrate with a discharge space in between, and unit light emitting areas formed to be partitioned by a partition wall having at least vertical walls extending in the column direction in a discharge space corresponding to each intersection of the column electrode and the row electrode pair, said plasma display panel comprising:

a first additional dielectric layer protruding from a backside of said dielectric layer toward the inside of the discharge space and extending along an edge of said unit light emitting area extending parallel to the row direction; and a second additional dielectric layer formed to protrude from a portion of the backside of said dielectric layer opposing said vertical wall of said partition wall toward the inside of the discharge space, and extend in the column direction to shield the adjacent unit light emitting areas in the row direction from each other in cooperation with said vertical wall.

2. The plasma display panel according to claim 1, wherein a clearance is formed in said second additional dielectric layer or said vertical wall of said partition wall to communicate between said unit light emitting areas adjacent to each other in the row direction.

3. The plasma display panel according to claim 1, wherein said partition wall has a transverse wall extending in the row direction, and defines the discharge space into a chessboard-square-like pattern with using said vertical walls and transverse walls to form said unit light emitting areas, and wherein said first additional dielectric layer and said transverse wall of said partition wall shield said adjacent unit light emitting areas in the column direction from each other.

4. The plasma display panel according to claim 1, wherein a black layer is formed on a face of said vertical wall of said partition wall on a display surface side.

5. The plasma display panel according to claim 3, wherein a black layer is formed on a face of said transverse wall of said partition wall on a display surface side.

6. The plasma display panel according to claim 1, wherein a black layer is formed on said first additional dielectric layer.

7. The plasma display panel according to claim 1, wherein a black layer is formed on said second additional dielectric layer.

* * * * *